US007165342B2

(12) United States Patent
Sheen

(10) Patent No.: US 7,165,342 B2
(45) Date of Patent: Jan. 23, 2007

(54) PROTECTIVE SHOE COVER

(76) Inventor: Randy T. Sheen, 1710 Bruce Dr., #21, Anderson, CA (US) 96007-4130

( * ) Notice: Subject to any disclaimer, the term of this patent is extended or adjusted under 35 U.S.C. 154(b) by 0 days.

(21) Appl. No.: 10/256,133

(22) Filed: Sep. 27, 2002

(65) Prior Publication Data

US 2004/0060199 A1 Apr. 1, 2004

(51) Int. Cl.

| | |
|---|---|
| ***A43B 5/00*** | (2006.01) |
| ***A43B 23/00*** | (2006.01) |
| ***A43C 13/14*** | (2006.01) |
| ***A43C 7/04*** | (2006.01) |

(52) U.S. Cl. ..... 36/2 B; 36/96; 36/72 R; 36/114

(58) Field of Classification Search ..... 36/2 B, 36/96, 114, 132, 136, 71, 70 R, 72 R
See application file for complete search history.

(56) References Cited

U.S. PATENT DOCUMENTS

| | | | | |
|---|---|---|---|---|
| 3,082,553 A | | 3/1963 | Wilmanns | |
| 3,334,427 A | * | 8/1967 | Edwards et al. | 36/72 R |
| 4,630,383 A | * | 12/1986 | Gamm | 36/136 |
| 5,094,016 A | * | 3/1992 | DiVito | 36/136 |
| 5,566,477 A | | 10/1996 | Mathis et al. | |
| 5,711,092 A | * | 1/1998 | Despres et al. | 36/72 R |
| 6,128,801 A | * | 10/2000 | Adzick et al. | 36/136 |
| 6,449,881 B1 | * | 9/2002 | Assaf et al. | 36/136 |

FOREIGN PATENT DOCUMENTS

| | | |
|---|---|---|
| GB | 2126872 | 4/1984 |

* cited by examiner

*Primary Examiner*—Anthony D. Stashick
(74) *Attorney, Agent, or Firm*—Richard C. Litman

(57) ABSTRACT

The shoe cover is formed from two sheets of tough flexible material shaped to cooperatively shield a shoe. The first sheet forms a first shield member for protecting the metatarsal area of a foot or shoe. The second sheet forms a second shield member, adjustably attachable to the first shield member and shaped to generally cover the toe area of the shoes. Eyelets are arranged on a fold area of the first shield member between fastener patches so that the upper portion of the sheet can be folded upon itself to cover shoelaces tied through the eyelets and the tongues of the shoes. A wide patch of hook and loop fastener material is secured onto the back face of the first shield member to cooperate with a narrower strip of fastener material secured to the second shield member to adjustably cover the toes of shoes in a range of sizes.

6 Claims, 6 Drawing Sheets

PROTECTIVE SHOE COVER

BACKGROUND OF THE INVENTION

1. Field of the Invention

The present invention relates to protective covers for workers feet, and more specifically, to a cover for protecting the laces, toe and tongue of a shoe and thus the metatarsal and toe areas of a workers feet from damage and injury due to falling objects and/or the chunks of molten metal produced during A welding process.

2. Description of the Related Art

A frequent problem for welders is the use of protective shoes. Falling cherries (small chunks of molten metal produced during the welding process) can easily burn through the laces and tongue of an unshielded work boot causing injury to the shoe and the foot within. Burned shoelaces can cause a shoe to become loosened and lead to tripping accidents and/or injuries. Also, unsightly burn damage ruins the appearance of the shoes.

Foot protection in the prior art has taken many forms. For example, U.S. Pat. No. 3,082,553 issued Mar. 26, 1963 to Wilmanus shows that it was a well known practice to use shoe shields for protecting the instep of feet. The shield of Wilmanus is saddle-like in form, i.e. concavo-convexly curved both longitudinally and laterally to fit the contour of the instep portion of a shoe. The shield is formed of any one of plastic, steel, aluminum wood or other hard lightweight material. The underside of the shield is lined with a sponge rubber shock absorber. The shield is permanently hinged onto the toe of a shoe and is provided at its distal end with a pair of apertures for tying down the shield with the laces of the shoe so as to permit the shield to be fixed in position on with the shoes. However, portions of the tongue of the shoe and the tied shoelaces are left unshielded, exposing those portions of the tongue and laces of the shoe to injury.

Published United Kingdom Patent Application 2,126,872 of Bechtel teaches a rigid shield hinged to the toe of a boot and extending over the metatarsal region of a foot. A stirrup passing under the sole of the boot and attached to the distal end of the shield transfers shock delivered to the shield down to the ground to protect the foot from injury. The shield is a permanent attachment to the shoe or boot.

In U.S. Pat. No. 5,566,477 issued to Mathis et al., a semi-rigid shield is shown which is shaped to conform to the tongue and shoelace area of a shoe and secured to that area by straps passing through slots in the shield. The exposed face of the shield includes a VELCRO™ type fastener device for removably securing a plurality of decorative fashion panels to the shoes.

None of the above inventions and patents, taken either singularly or in combination, is seen to describe the instant invention as claimed. Thus a shoe cover solving the aforementioned problems is desired.

SUMMARY OF THE INVENTION

The present invention provides a protective shoe cover which is removably attachable to shoes having laces. The shoe cover fully protects not only the metatarsal areas of a wearer's feet, but also the laces, toe and tongue of the wearer's shoes from damage or injure due to falling objects and/or falling molten weld fragments.

The shoe cover is formed from two sheets of tough flexible material, such as leather. The two sheets of material are shaped to cooperatively shield a shoe from the metatarsal area to the toe tip from falling cherries. The first sheet forms a first shield member for protecting the area of the shoe covering the metatarsal area of a foot or the shoe lace and tongue area of shoes. The second sheet forms a second shield member that is adjustably attachable to the first shield member and shaped to generally cover the toe area of shoes.

The first shield member is rectangular in shape. First and second VELCRO™ hook and loop fastener patches are placed in the upper left and right corners of the front face of first shield portion. Second and third VELCRO™ hook and loop fastener patches are also secured to the front face of the first shield member adjacent the left and right side edges. The second and third fastener patches are place nearly two thirds the length from the top edge of the first shield member for cooperative mating engagement with the first and second fastener patches.

A pair of eyelets are arranged on the first shield member between the fastener patches in a manner so that when shoe laces are passed through the eyelets and tied into a bow upon the front face of the first shield member, the upper portion of the sheet can be folded upon itself to cover the shoe laces and the tongues of the shoes and secured into position by the mating attachment of the hook and loop fastener patches.

A wide patch of VELCRO™ hook and loop fastener material is secured adjacent the lower edge of the back face of the first shield member which extends from the right side edge to the left side edge of the back face of the first shield member. This wide patch cooperates with a narrower strip of fastener material secured along the top edge of the front face of the second shield member to adjustably cover the toes of shoes in a range of sizes, for example from eight and a half to ten and a half in mens size.

The second shield member is D-shaped, having one straight edge and one curved edge. The narrow strip of fastener material extends along the straight edge on the front face of the second shield member. In use the second shield member is removably attachable to the fastener material on the back face of the first shield member. The placement of the narrow strip on the wide strip of fastener material determines the size of the shoe to be covered by the protective shoe cover.

When affixed to a shoe, the shoe cover not only protects the feet of welder from injury due to falling objects and falling molten weld fragments, but also protects the lace, tongue and toe portions of a wearer's shoes from scuffs and burn damage.

Accordingly, it is a principal object of the invention to provide a protective shoe cover for protecting a welder's feet from burn injuries caused by falling molten weld fragments.

It is another object of the invention to provide a protective shoe cover for protecting the lace, toe and tongue areas of welder's shoes from burn damage due to falling fragments of molten weld material.

It is a further object of the invention to provide a protective shoe cover allowing for quick and easy placement and removal upon the shoes of a welder.

It is a still further object of the invention to provide a protective shoe cover allowing for easy adjustment to fit upon and protect a number of shoes in a particular size range.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a shoe shield or cover, which is removably attachable to shoes having laces. The cover, when affixed on a welder's shoe, fully protects not only the metatarsal areas of a welder's foot, but also the tongue and laces of the welder's shoe from damage or injure due to falling objects or falling molten weld fragments.

Figure 1:
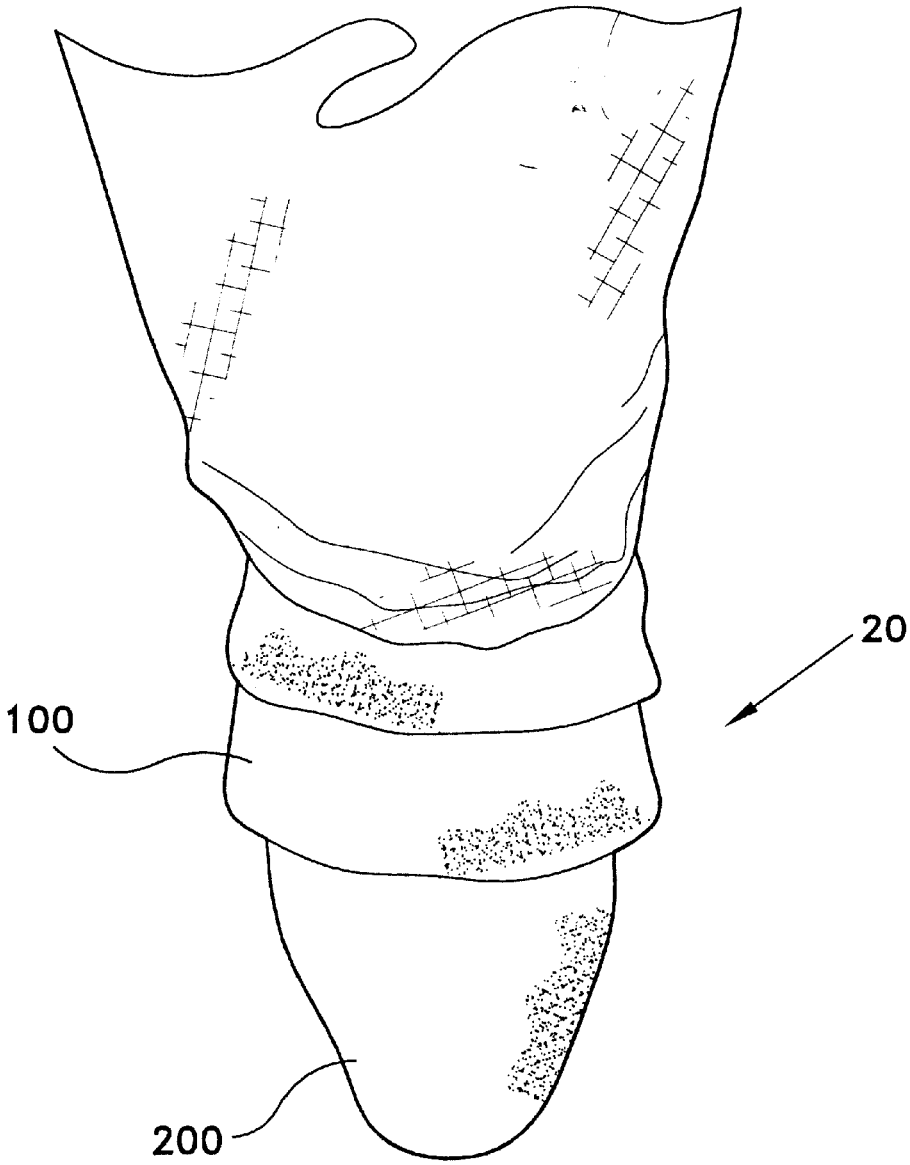
FIG. 1 is a perspective view of the shoe cover with both sheets fully attached to a shoe, according to the present invention.
Figure 2:
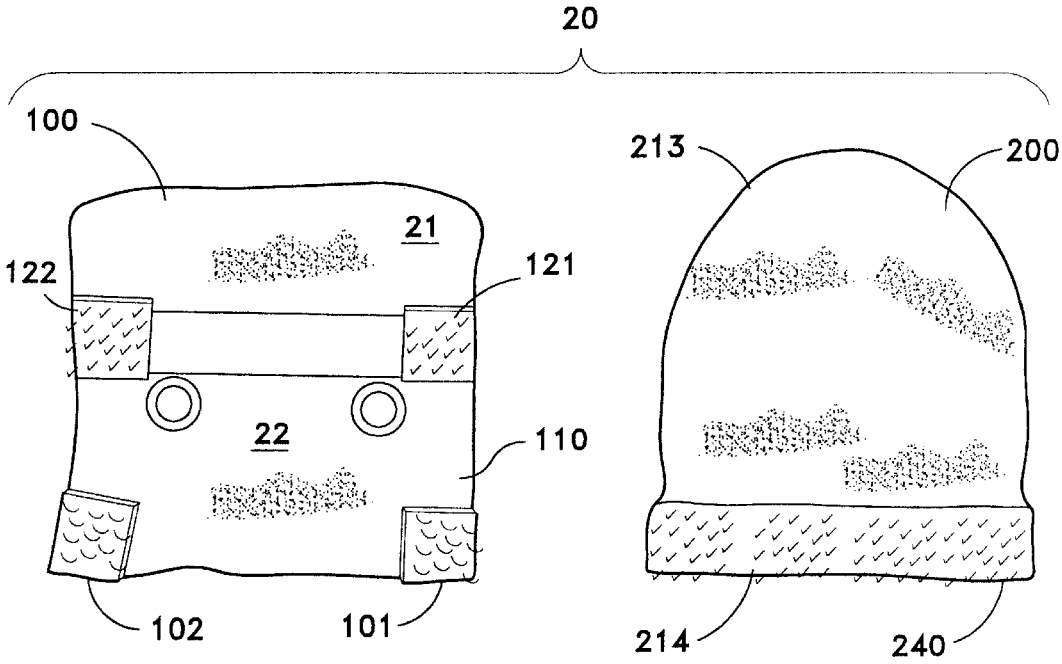
FIG. 2 is a top view of the front face of the two sheets forming the shoe cover of FIG. 1 according to the present invention.
Figure 5:
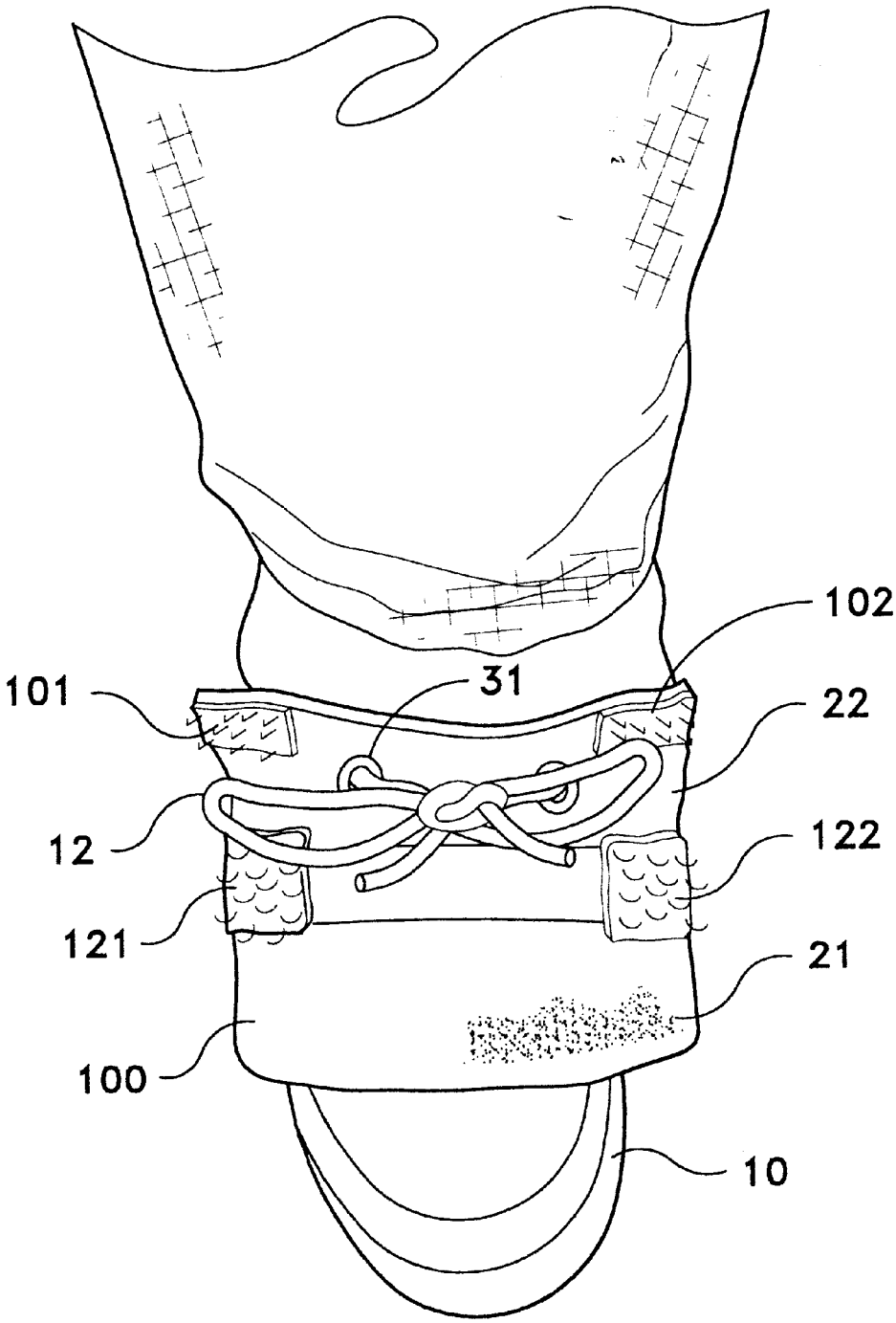
FIG. 5 is a perspective view of the first sheet of the shoe cover secured to a shoe with the laces of the shoe, according to the present invention.
Figure 6:
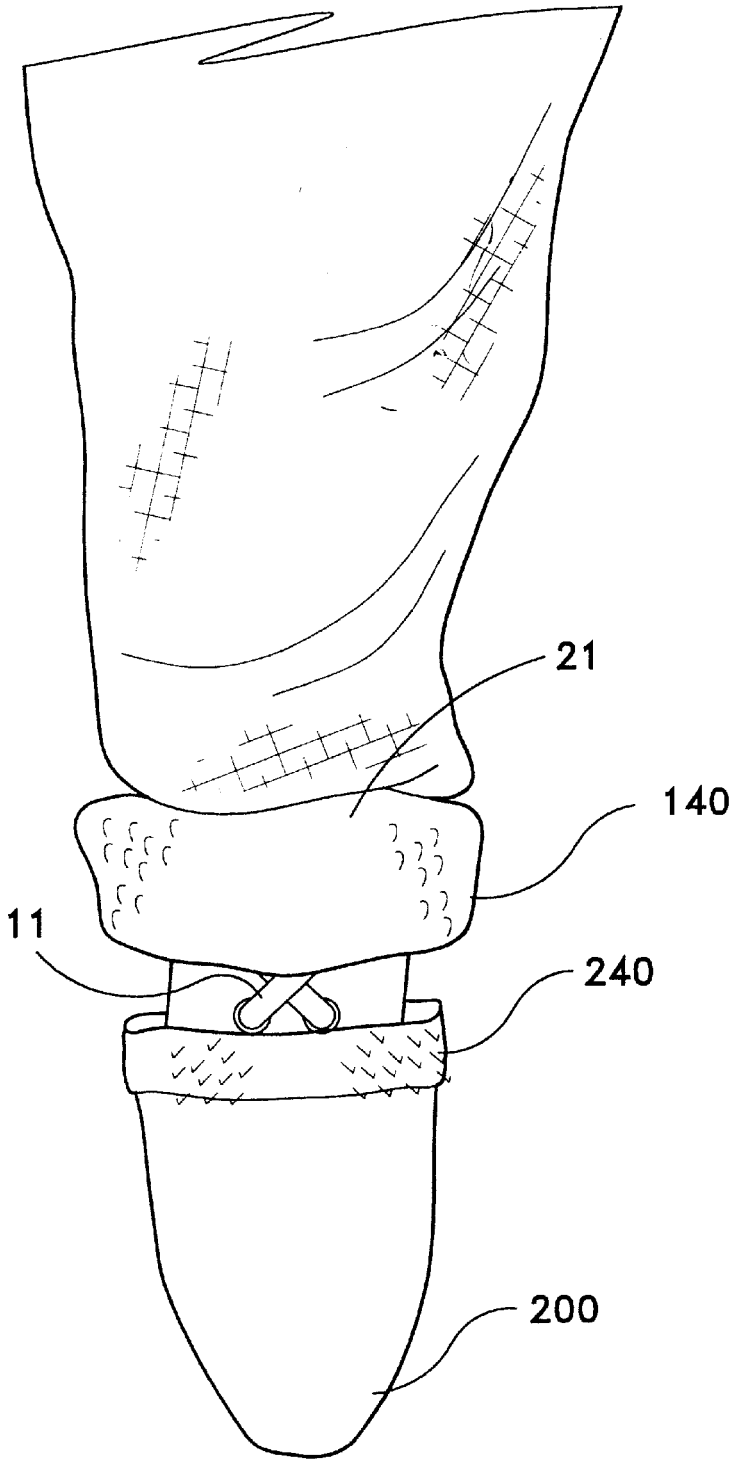
FIG. 6 is a perspective view of the second sheet of the shoe cover placed in position upon a shoe to be secured by hook and loop fasteners to the bottom of the first sheet.

FIGS. 1, 5 and 6 illustrate the protective shoe cover 20 in various stages of attachment to the shoe 10 of a welder. The shoe cover 20 comprises a first sheet or shield member 100 of tough flexible material, such as leather for example that is shaped to cover the lace and tongue areas of the welder's shoe 10. The sheet 100 has a cover portion 21 and a flap portion 22. The cover portion 21 is folded upon an adjacent area of the flap portion 22, as best seen in FIG. 5. A pair of eyelets 31 is formed on the first sheet 100. The eyelets 31 are placed in an area on first sheet 100 adjacent the fold area 30 between the cover portion 21 and the flap portion 22. The eyelets 31 are positioned so as to receive the laces 11 of the welder's shoe. The laces 11 are threaded through the eyelets 31 and tied into a bow 12 to secure the first sheet 100 onto the welder's shoe 10 covering the laces and tongue of the shoe from damage.

Figure 3:
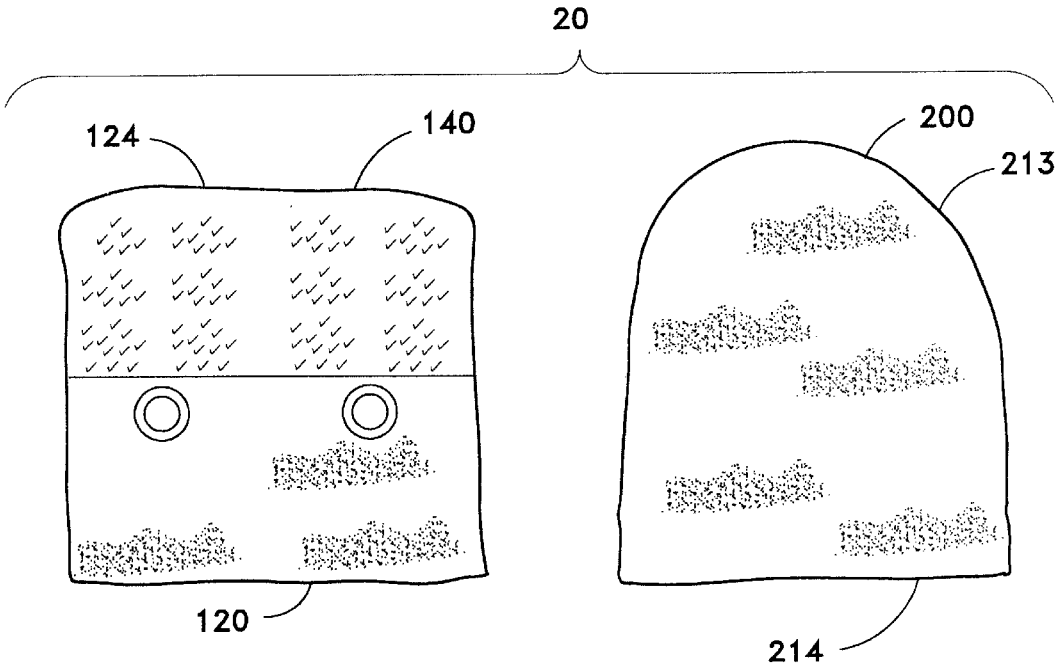
FIG. 3 is a top view of the back faces of the two sheets forming the shoe cover of FIG. 1, according to the present invention.
Figure 4:
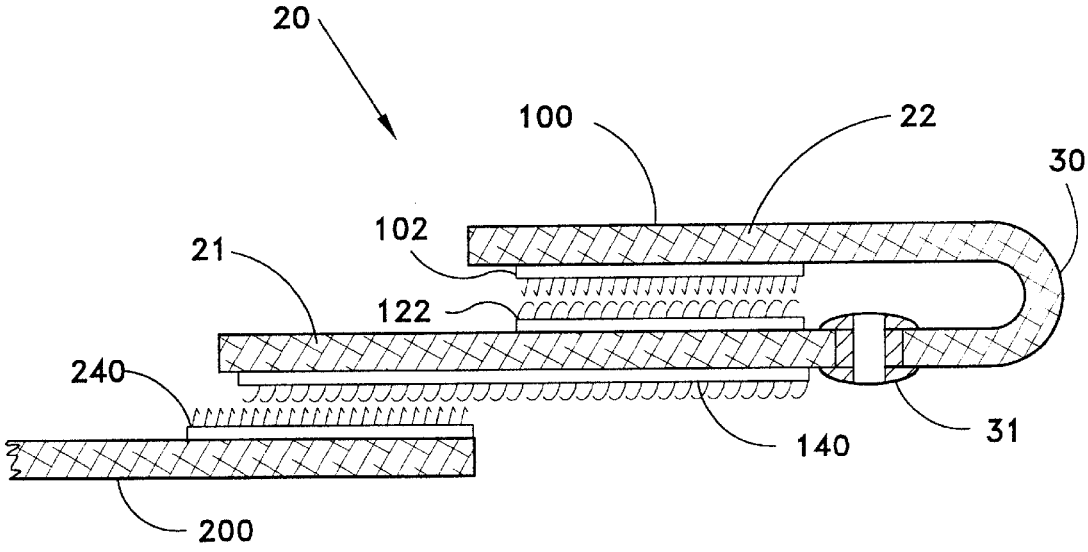
FIG. 4 is cross-sectional view of the two sheets with the flap of the first sheet folded over for securing with hook and loop fasteners, according to the present invention.

As best seen in FIG. 3 a wide VELCRO™ hook or loop fastener strip 140 is affixed to the rear face of the cover portion 21 of the first sheet 100 adjacent a lower edge 124. Fastener strip 140 cooperates with a VELCRO™ loop or hook fastener patch 240 affixed along the straight edge 214, opposite the curved edge 213, of the front face of D-shaped sheet 200 by any suitable means such as adhesives or stitching. The fastener strip 140 on sheet 100 is larger than fastener strip 240 on sheet 200.

After the laces are tied into a bow 12, the flap portion 22 is folded onto the adjacent area of the cover portion 21 covering the bow 12 and removably secured to the cover portion 21 using fastener patches 101,102 and 121,122. When affixed to a welder's shoe 10, the first sheet 100 protects the metatarsal area of a welder's foot from injury due to falling objects and burns caused by falling molten weld fragments. In addition, the shoe cover 20 also protects the shoelaces 11, tongue and instep portions of a welder's shoes 10 from damage due to falling objects and molten weld fragments. Cover portion 21 is folded back as shown in FIG. 6 to expose the fastener strip 140. Strip 240 of sheet 200 attachable to strip 140 so as to adjustably extend sheet 200 to cover the toe area of welder's shoes in different sizes.

When the shoe cover 20 is no longer needed, strip 140 is removed from strip 240 so that sheet 200 is removed from the shoe. The flap portion 22 is pulled off the cover portion 21 and the bow 12 untied to remove sheet 100 from the shoes. In this manner, shoe cover 20 is conveniently removed for later use and the shoes retied for wear in public.

It is to be understood that the present invention is not limited to the embodiments described above, but encompasses any and all embodiments within the scope of the following claims.

I claim:

1. A protective shoe cover for protecting a workman's feet and shoes from injury due to falling objects or falling molten metal weld fragments comprising:

a first sheet of tough flexible material, sized and shaped to cover the tongue and lacing area of a shoe, said sheet having a cover portion and a flap portion, said flap portion is foldable onto said cover portion;

at least two eyelets for receiving the laces of a shoe formed in a fold area between said flap portion and said cover portion;

first releasable fastening elements secured onto the flap portion;

second releasable fastening elements secured onto said cover portion for cooperatively engaging said first fastening elements;

said first and second releasable fastening elements cooperating to adjustably secure said flap portion onto said cover portion in a manner so as to cover said at least two eyelets a wide strip of releasable fastener material secured onto a back face of said first sheet adjacent a lower edge thereof; and a second sheet of tough flexible material, sized and shaped to cover the toe of shoes in a range of sizes, said second sheet having a narrow strip of releasable fastener material adjacent a straight edge of said second sheet, wherein the narrow strip of fastener material on said second sheet cooperates with the wide strip of fastener material to adjustably secure said second sheet onto said first sheet such the laces, tongue and toe areas of a welder's shoes are covered by said first and second sheets.

2. A shoe cover according to claim 1, wherein said releasable fastening elements are hook and loop fasteners.

3. A shoe cover according to claim 2, wherein said sheets are formed of leather.

4. A shoe cover according to claim 1, wherein said strips of releasable fastening material are cooperating hook and loop fastener strips.

5. A shoe cover according to claim 4, wherein said releasable fastening elements are hook and loop fasteners.

6. A protective shoe cover for protecting a workman's feet and shoes from injury due to falling objects or falling molten metal weld fragments comprising:

a first sheet of tough flexible material, sized and shaped to cover the tongue and lacing area of a shoe, said sheet having a cover portion and a flap portion, said flap portion is foldable onto said cover portion;

at least two eyelets for receiving the laces of a shoe formed in a fold area between said flap portion and said cover portion;

first releasable fastening elements secured onto the flap portion;

second releasable fastening elements secured onto said cover portion for cooperatively engaging said first fastening elements;

said first and second releasable fastening elements cooperating to adjustably secure said flap portion onto said cover portion in a manner so as to cover said at least two eyelets a wide strip of releasable fastener material secured onto a back face of said first sheet adjacent a lower edge thereof;

a second sheet of tough flexible material, sized and shaped to cover the toe of shoes in a range of sizes, said second sheet having a narrow strip of releasable fastener material adjacent a straight edge of said second sheet, wherein the narrow strip of fastener material on said second sheet cooperates with the wide strip of fastener material to adjustably secure said second sheet onto said first sheet such the laces, tongue and toe areas of a welder's shoes are covered by said first and second sheets; and wherein said first and second sheets are formed of leather.

* * * * *